US005377365A

United States Patent [19]

Hakim

[11] Patent Number: 5,377,365

[45] Date of Patent: Jan. 3, 1995

[54] NECK SUPPORT FOR BEAUTY SALON HAIR WASHING SINKS

[76] Inventor: Shaharazard H. Hakim, 58 Rottkamp St., Valley Stream, N.Y. 11580

[21] Appl. No.: 251,344

[22] Filed: May 31, 1994

[51] Int. Cl.[6] ..... A45D 19/00; A47K 1/04

[52] U.S. Cl. ..... 4/523; 4/519

[58] Field of Search ..... 4/516, 517, 518, 519, 4/523, 575.1, 621

[56] References Cited

U.S. PATENT DOCUMENTS

| | | | |
|---|---|---|---|
| 522,192 | 7/1894 | Browne | 4/523 |
| 1,957,608 | 5/1934 | McCann | 4/523 |
| 1,961,244 | 6/1934 | Pottern | 4/523 |
| 2,261,476 | 11/1941 | Kiefer | 4/519 |
| 3,428,361 | 2/1969 | Reynolds | 4/523 |
| 4,385,408 | 5/1983 | Rhodes | 4/519 |
| 4,389,740 | 6/1983 | Henry | 4/575.1 |
| 4,828,257 | 11/1989 | Hardin | 4/523 |
| 4,922,558 | 5/1990 | Porco | 4/523 |
| 5,177,820 | 1/1993 | Varallo | 4/523 |

*Primary Examiner*—Henry J. Recla
*Assistant Examiner*—Charles R. Eloshway

[57] ABSTRACT

A neck support for beauty salon hair washing sinks comprising a pillow formed of an elastomeric foam with a water proof envelope thereover; a coupling assembly, having a downwardly extending exterior member and a downwardly extending interior member, the members being positionable over the upper edge of a beauty salon sink, the coupling assembly having a pair of suction cups on the interior member facing the exterior member, the coupling assembly also including apertures extending through the exterior member with a threaded bolt extending therethrough, the bolt having a handle on its exterior end and a suction cup on the interior end facing the inferior member, the suction cups adapted to contact the opposed faces of the sink for positioning and support thereadjacent; and adjustment member between the coupling assembly and the pillow.

4 Claims, 4 Drawing Sheets

14
12
16
68
10
62
62
58

60
46
40
66
42
48
48
5
5
50
50
44
24
20
3
24
28
28
26
26
3

NECK SUPPORT FOR BEAUTY SALON HAIR WASHING SINKS

BACKGROUND OF THE INVENTION

1. Field of the Invention

The present invention relates to a neck support for beauty salon hair washing sinks and, more particularly, pertains to supporting the neck of a patron of a beauty salon during the hair washing or other hair treatment over a sink.

2. Description of the Prior Art

The use of sinks for use in beauty salon including associated head and neck resting areas is known in the prior art. More specifically, sinks for use in beauty salons including associated head and neck resting areas heretofore devised and utilized for the purpose of supporting the neck of a person while their head is over a sink for being washed or for other purposes are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,385,408 to Rhodes discloses a sanitary cushioning device for sink bowl edges.

U.S. Pat. No. 4,922,558 to Porco discloses a headrest for use in beauty shop shampoo bowls, sinks and the like.

U.S. Pat. No. 4,998,303 to Smithers discloses a head support for salon basin.

U.S. Pat. No. 5,177,820 to Varallo discloses a hairdressing head support.

U.S. Pat. No. 5,239,711 to Tafur discloses a headset for shampoo bowls and sinks.

In this respect, the a neck support for beauty salon hair washing sinks according to the present invention substantially departs from the conventional concepts and designs of the prior art, and in so doing provides an apparatus primarily developed for the purpose of supporting the neck of a patron of a beauty during the washing or other hair treatment over a sink.

Therefore, it can be appreciated that there exists a continuing need for new and improved a neck support for beauty salon hair washing sinks which can be used for supporting the neck of a patron of a beauty salon during the washing or other hair treatment over a sink. In this regard, the present invention substantially fulfills this need.

SUMMARY OF THE INVENTION

In view of the foregoing disadvantages inherent in the known types of sinks for use in beauty salons including associated head and neck resting areas now present in the prior art, the present invention provides an improved neck support for beauty salon hair washing sinks. As such, the general purpose of the present invention, which will be described subsequently in greater detail, is to provide a new and improved a neck support for beauty salon hair washing sinks apparatus and method which has all the advantages of the prior art and none of the disadvantages.

To attain this, the present invention essentially comprises a new and improved neck support for beauty salon hair washing sinks comprising, in combination, a pillow formed of an elastomeric foam with a water proof envelope thereover; a coupling assembly having a downwardly extending exterior member and a downwardly extending interior member, the members being positionable over the upper edge of a beauty salon sink, the coupling assembly having a pair of suction cups on the interior member facing the exterior member, the coupling assembly also including apertures extending through the exterior member with a threaded bolt extending therethrough, the bolt having a handle on its exterior end and a suction cup on the interior end facing the inferior member, the suction cups adapted to contact the opposed faces of the sink for positioning and support thereadjacent; an intermediate assembly between the pillow and the coupling assembly, the intermediate assembly including a rachet, the lower end of which is secured to the coupling assembly and the upper end of which is coupled to the pillow with opposed circular components with engaging serrated teeth on the facing sides thereof, the circular components adapted to rotate about a horizontal axis to vary the angular orientation of the pillow with respect to the coupling assembly and a spring coupling the circular components to maintain the teeth in engagement in the position last set until moved by a user through the application of a rotational force.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will for the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved neck support for beauty salon hair washing sinks which has all the advantages of the prior art sinks for use in beauty salons including associated head and neck resting areas and none of the disadvantages.

It is another object of the present invention to provide a new and improved neck support for beauty salon hair washing sinks which may be easily and efficiently manufactured and marketed.

It is a further object of the present invention to provide a new and improved neck support for beauty salon hair washing sinks which is of a durable and reliable construction.

An even further object of the present invention is to provide a new and improved neck support for beauty salon hair washing sinks which is susceptible of a low cost of manufacture with regard to both materials and labor, and which accordingly is then susceptible of low prices of sale to the consuming public, thereby making such sinks for use in beauty salons including associated head and neck resting areas economically available to the buying public.

Still yet another object of the present invention is to provide a new and improved neck support for beauty salon hair washing sinks which provides in the apparatuses and methods of the prior art some of the advantages thereof, while simultaneously overcoming some of the disadvantages normally associated therewith.

Still another object of the present invention is to support the neck of a patron of a beauty salon during the washing or other hair treatment over a sink.

Lastly, it is an object of the present invention to provide new and improved neck support for beauty salon hair washing sinks comprising a pillow formed of an elastomeric foam with a water proof envelope thereover; a coupling assembly having a downwardly extending exterior member and a downwardly extending interior member, the members being positionable over the upper edge of a beauty salon sink, the coupling assembly having a pair of suction cups on the interior member facing the exterior member, the coupling assembly also including apertures extending through the exterior member with a threaded bolt extending therethrough, the bolt having a handle on its exterior end and a suction cup on the interior end facing the inferior member, the suction cups adapted to contact the opposed faces of the sink for positioning and support thereadjacent; and adjustment means between the coupling assembly and the pillow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part throughout the various Figures.

DESCRIPTION OF THE PREFERRED EMBODIMENT

Figure 1:
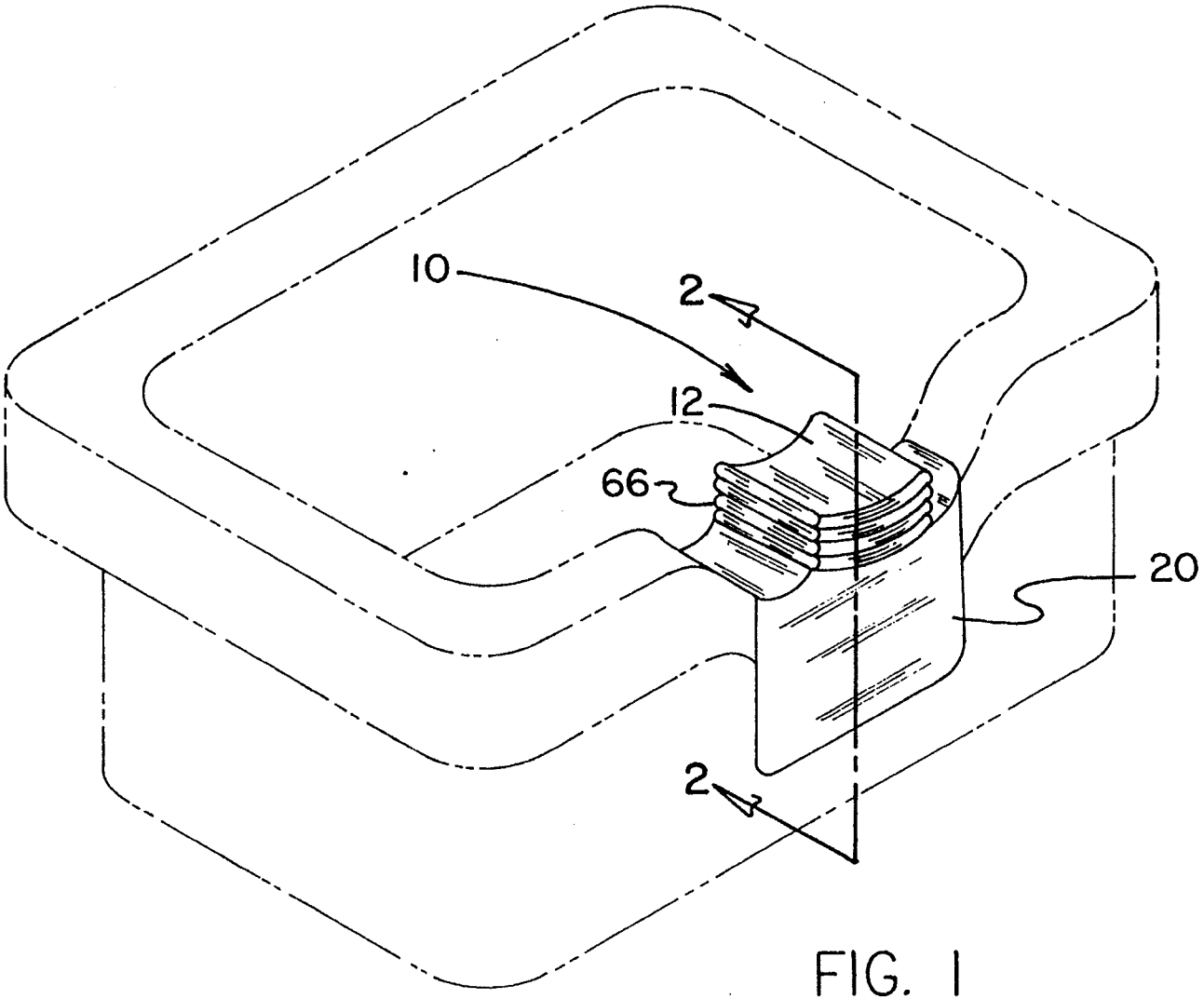
FIG. 1 is a perspective view of the preferred embodiment of the new and improved neck support for beauty salon hair washing sinks constructed in accordance with the principals of the present invention.
Figures 2, 4:
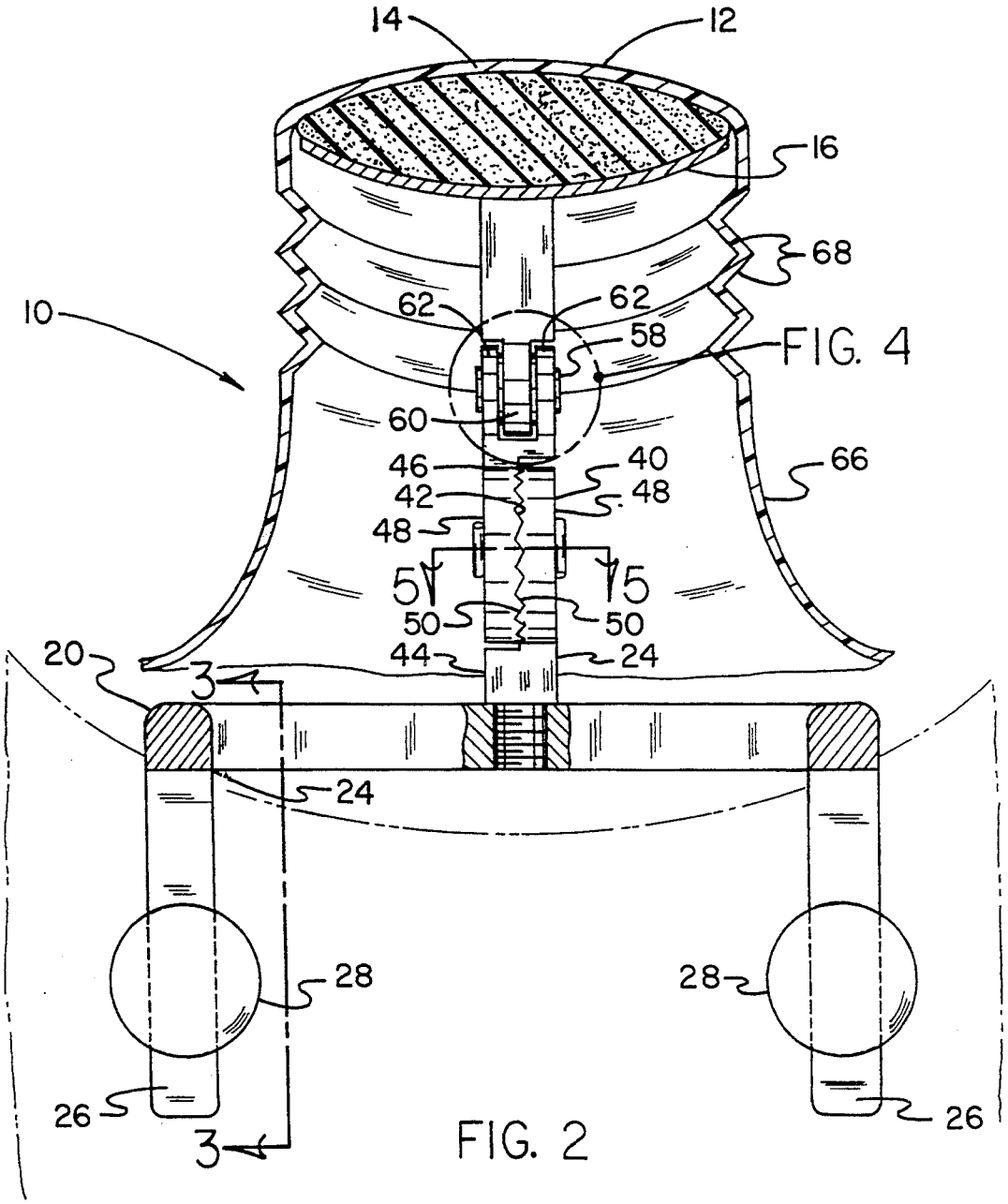
FIG. 2 is a cross-sectional view of the device shown in FIG. 1 taken along line 2—2 of FIG. 1.
FIG. 4 is an enlarged showing of a central component of the device of the prior Figures taken about several form of FIG. 2.
Figure 3:
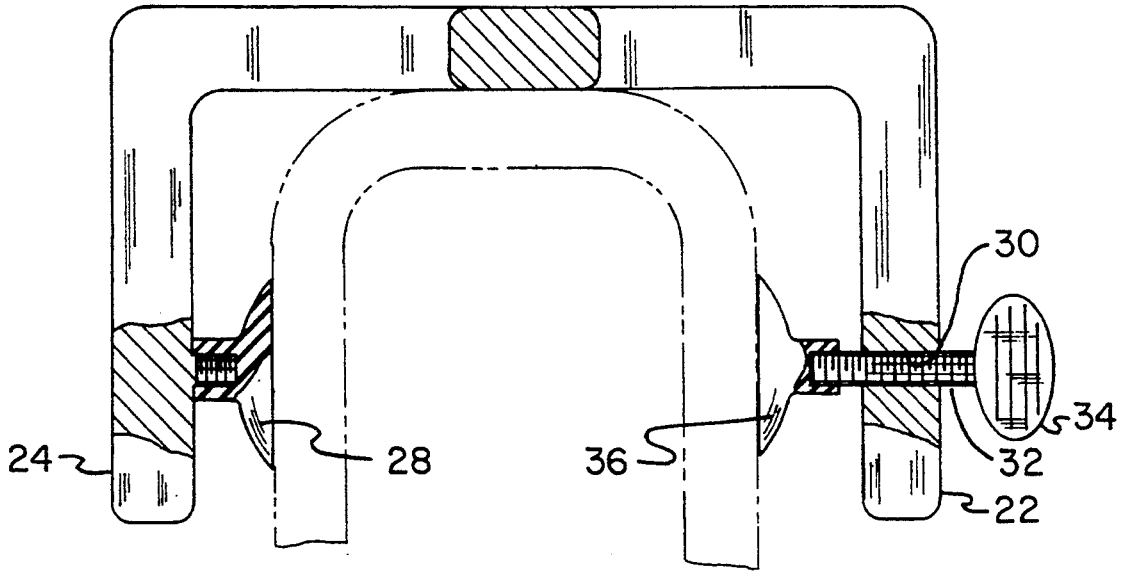
FIG. 3 is a cross-sectional view taken along line 3—3 of FIG. 2.
Figure 4:
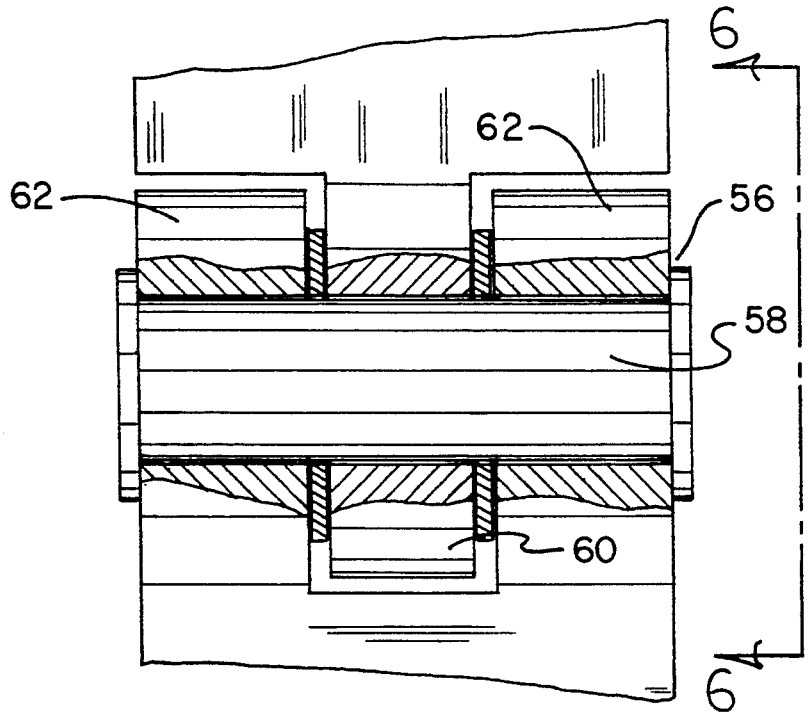
Figure 5:
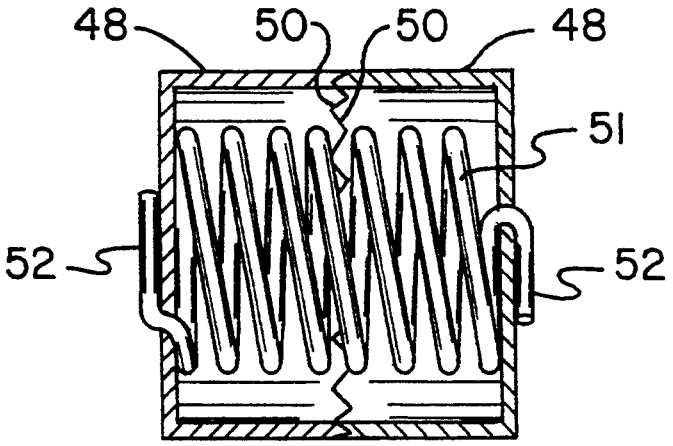
FIG. 5 is a cross-sectional view of a portion of the coupling component taken along line 5—5 of FIG. 2.
Figure 6:
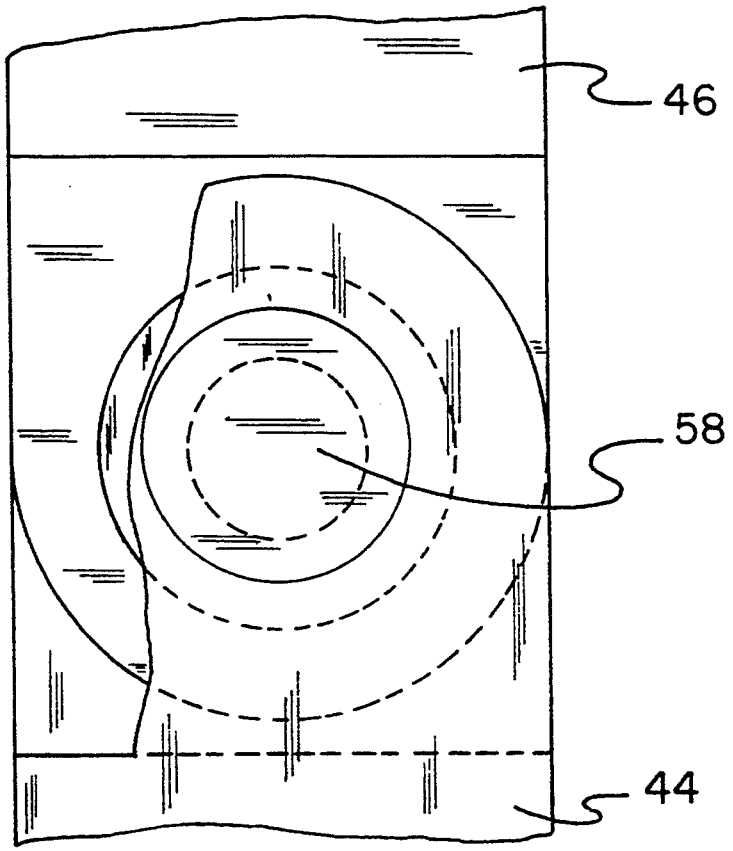
FIG. 6 is a cross-sectional view taken along line 6—6 of FIG. 4.

With reference now to the drawings, and in particular to FIG. 1 thereof, a new and improved a neck support for beauty salon hair washing sinks embodying the principles and concepts of the present invention and generally designated by the reference numeral 10 will be described.

More specifically, the present invention is a system 10. The central component of the system is a pillow 12. The pillow is formed of an elastomeric foam. It is provided with a waterproof envelope 14 for protecting the pillow during operation and use. The pillow is adapted to be supported by a rigid metallic support 16. The support is of a curved configuration corresponding to the curvature of the neck of a user.

With the pillow at the top of the device, there is provided at the bottom of the device, a coupling assembly 20. A coupling assembly is adapted to removably secure the device with respect to the upper edge of a beauty salon sink in which it is to be utilized. The coupling assembly is provided with a downwardly extending exterior member 22 and a downwardly extending interior member 24. The exterior member is formed of two parallel fingers or extensions 26. The extensions are on opposite sides of the neck of the user. Similarly, the interior member is formed of two laterally disposed fingers, parallel with each other and parallel with the fingers of the exterior member. The edge of the plates located between the exterior member and the interior member. The members are positionable over the upper edge of a beauty salon sink.

The coupling assembly has a pair of suction cups 28 on the interior member facing the exterior member with the interior face of the sink thereadjacent. The coupling member also includes apertures 30 extending through the exterior member. A threaded bolt 32 extends through the apertures for adjustment purposes. The bolt has a handle 34 on its exterior end and a suction cup 36 on the interior end facing the interior member. The suction cups together are adapted to contact the opposed faces of the sink for positioning and supporting the device, including the pillow in a proper orientation with respect to the sink.

Next provided are adjustment components. The adjustment components include an intermediate assembly 40. Such intermediate assembly is located between the pillow and the coupling assembly. The intermediate assembly includes a rachet 42. The lower end 44 of the rachet is secured to the coupling assembly. The upper end 46 of the rachet is coupled to the pillow. The rachet includes opposed circular components 48 with engaging serrated teeth 50. The teeth are facing sides of the circular components. The circular components are adapted to rotate about a horizontal axis through the center of the circular components. This allows the varying the angular orientation of the pillow with respect to the coupling assembly. A spring 51 has its free ends 52 secured to the circles remote from the serrated teeth. This spring couples the circular components and maintains their teeth engagement with respect to each other in the position last sat. Such position will be maintained during operation and use until moved by a user through the application of a rotational force to the circular components.

Next provided in the adjustment means is a pivot member 56. The pivot member couples the pillow and the intermediate ratchet assembly. The pivot member includes a pivot pin 58. The pivot pin couples the free ends of the adjustment means thorough apertures extending therethrough. The upper component having a downwardly extending central element 60. The lower member has upwardly extending elements 62 on opposite sides of the central member. The pivot pin extends therethrough by extending through aligned apertures. The pivot then allows for varying the angular orientation of the pillow with respect to the intermediate assembly and the coupling assembly.

The last component of the system is a liquid impervious shroud 66. Such shroud is formed as an extension of the envelope surrounding the pillow. The shroud extends downwardly to encompass the device. The upper end of the shroud is formed with accordion pleats 68. Such pleats maintain the exterior surface of the shroud and device in asymmetric orientation during operation and use regardless of the angular orientation of the pillow with respect to the other components of the system.

The present invention is designed to support the head and neck of a client at a hair styling salon as his/her hair is being washed. It is simply comprised of a base, a support, and the nest. The base is made of rigid plastic and straddles the forward vertical wall of the sink. It is approximately the width of one's shoulders, and its rear surface is sloped and contoured to both collect the flow of water and direct it back into the sink.

A steel frame is housed within the lower section of the base and transverses its width. This frame has two yoke-like extensions, one at either end, and thumb screws through each of the outboard arms serve to secure the base over the wall of the sink. In addition, suction cups hold the base in a fixed position so that it will not slide across the sink.

The support is comprised of a central post and contoured pedestal. The post features an adjustable ratchet-like mechanism which facilitates rotation of the pedestal through an arc of 180 degrees in increments of one quarter of an inch. The pedestal, or nest, is semi-circular in shape and mounted at the top of the post. This entire assembly is covered by a bellows-like sheath, with accordion type pleats draped over the nest and attached to the base. This cover is made of a flexible material with a sponge cushion entrapped below its top surface.

The present invention is simply installed and its features are designed to enhance the comfort of a client while promoting repeat business. Through the chairs used in these establishments typically recline, they do not afford support for the head and neck, and strain can be induced during a lengthy session.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved neck support for beauty salon hair washing sinks comprising, in combination:

a pillow formed of an elastomeric foam with a water proof envelope thereover;

a coupling assembly having a downwardly extending exterior member and a downwardly extending interior member, the members being positionable over an upper edge of a beauty salon sink wall, the coupling assembly having a pair of suction cups on the interior member facing the exterior member, the coupling assembly also including apertures extending through the exterior member with a threaded bolt extending therethrough, the bolt having a handle on its exterior end and a suction cup on the interior end facing the interior member, the suction cups adapted to contact opposing faces of the sink wall for positioning and support thereadjacent;

an intermediate assembly between the pillow and the coupling assembly, the intermediate assembly including a rachet, a lower end of which is secured to the coupling assembly and an upper end of which is coupled to the pillow with opposed circular components with engaging serrated teeth on facing sides thereof, the circular components adapted to rotate about a horizontal axis to vary the angular orientation of the pillow with respect to the coupling assembly and a spring coupling the circular components to maintain the teeth in engagement until moved by a user through application of a rotational force.

2. A neck support for beauty salon hair washing sinks comprising:

a pillow formed of an elastomeric foam with a water proof envelope thereover;

a coupling assembly having a top, a downwardly extending exterior member and a downwardly extending interior member, said members connected to said top, the members being positionable over an the upper edge of a beauty salon sink wall, the coupling assembly having a pair of suction cups on the interior member facing the exterior member, the coupling assembly also including apertures extending through the exterior member with a threaded bolt extending therethrough, the bolt having a handle on its exterior end and a suction cup on the interior end facing the interior member, the suction cups adapted to contact opposing faces of the sink wall for positioning and support thereadjacent; said pillow being connected to said top of said coupling assembly; and adjustment means between the coupling assembly and the pillow.

3. The apparatus as set forth in claim 2 wherein the adjustment means further includes a pivot component between the exterior member and interior member.

4. The apparatus as set forth in claim 2 and further including a liquid impervious shroud over the adjustment means, and pivot component.

* * * * *